US006550583B1

(12) United States Patent
Brenhouse

(10) Patent No.: US 6,550,583 B1
(45) Date of Patent: Apr. 22, 2003

(54) APPARATUS FOR SELF-SERVE CHECKOUT OF LARGE ORDER PURCHASES

(75) Inventor: Elliot Brenhouse, Cote St. Luc (CA)

(73) Assignee: Optimal Robotics Corp., Quebec (CA)

( * ) Notice: Subject to any disclaimer, the term of this patent is extended or adjusted under 35 U.S.C. 154(b) by 103 days.

(21) Appl. No.: 09/642,716

(22) Filed: Aug. 21, 2000

(51) Int. Cl.[7] ..... A63F 9/02
(52) U.S. Cl. ..... 186/66; 186/61
(58) Field of Search ..... 186/61, 66

(56) References Cited

U.S. PATENT DOCUMENTS

| | | | | |
|---|---|---|---|---|
| 1,580,163 A | | 4/1926 | Peterson et al. | |
| 2,324,596 A | | 7/1943 | Quain | |
| 3,628,632 A | | 12/1971 | Lambert | |
| 3,819,012 A | * | 6/1974 | Beck et al. | 186/61 |
| 4,389,834 A | | 6/1983 | Wysocki | |
| 4,661,908 A | | 4/1987 | Hamano et al. | |
| 4,676,343 A | | 6/1987 | Humble et al. | |
| 4,787,467 A | | 11/1988 | Johnson | |
| 5,083,638 A | | 1/1992 | Schneider | |
| 5,115,888 A | | 5/1992 | Schneider | |
| 5,123,494 A | | 6/1992 | Schneider | |
| 5,125,465 A | | 6/1992 | Schneider | |
| 5,131,499 A | | 7/1992 | Hoar | |
| 5,168,961 A | | 12/1992 | Schneider | |
| 5,174,399 A | | 12/1992 | Brauneis | 177/25.15 |
| 5,358,094 A | | 10/1994 | Molinaro et al. | |
| 5,410,108 A | * | 4/1995 | Williams et al. | 177/126 |
| 5,551,531 A | | 9/1996 | Dumont | 186/61 |
| 5,620,061 A | | 4/1997 | Fraser | |
| 5,752,582 A | * | 5/1998 | Hayward | 186/61 |
| 5,965,861 A | * | 10/1999 | Addy et al. | 186/61 |
| 6,032,128 A | * | 2/2000 | Morrison et al. | 186/61 |
| 6,056,087 A | * | 5/2000 | Addy et al. | 16/66 |
| 6,215,078 B1 | * | 4/2001 | Torres et al. | 177/25.15 |
| 6,296,184 B1 | * | 10/2001 | Dejaeger | 235/383 |
| 6,325,290 B1 | * | 12/2001 | Walter et al. | 186/59 |

FOREIGN PATENT DOCUMENTS

EP 0 498 311 1/1992

OTHER PUBLICATIONS

NCR Self–Chekout brochure.
International Search Report dated Dec. 20, 2001 for PCT/IB01/01704.

* cited by examiner

*Primary Examiner*—Donald P. Walsh
*Assistant Examiner*—Jeffery A. Shapiro
(74) *Attorney, Agent, or Firm*—Drew M. Wintringham; James V. Mahon; Clifford Chance US LLP

(57) ABSTRACT

An apparatus for self-serve checkout of large order purchases is provided. The apparatus includes one or more product code entry devices for entering a product code of an item to be purchased, a controller and a carousel assembly that includes a rotating mechanism, a rack coupled with the rotating mechanism, and a scale underneath the rotating mechanism and rack. The rack holds a plurality of bags open for packing a plurality of items, and may be rotated along with the rotating mechanism to present a select one of the bags for packing the item to be purchased. The scale provides a weight signal corresponding to a weight of packed items in the plurality of bags on the carousel. The controller monitors the weight signal to detect any abnormal weights or weight changes. The apparatus also may be provided with a large item holding assembly that includes a second scale which provides a second weight signal corresponding to the weight of one or more oversized items on the large item holding assembly.

14 Claims, 9 Drawing Sheets

APPARATUS FOR SELF-SERVE CHECKOUT OF LARGE ORDER PURCHASES

FIELD OF THE INVENTION

The present invention relates to an apparatus for self-serve checkout of large order purchases at a retail store. In particular, the invention relates to a self-serve checkout station with a carousel bagging platform.

BACKGROUND OF THE INVENTION

Over the past few decades, retail point of sales systems have been greatly automated to expedite the checkout process. Technology has contributed significantly to advancements in the retail checkout process, as it has done in virtually all arenas of life.

In the typical retail environment, the customer selects various items for purchase and brings these items to a store clerk for checkout. In the traditional environment, the store clerk would tally the price of the items to be purchased either by hand or by entry of the price into a mechanical or electronic adding machine, which typically is integrated with a cash register into a point-of-sales terminal.

Over the last two decades, point-of-sales terminals have been further enhanced to be part of a computer-based point-of-sales system that includes a database of prices, inventory and other information related to the items for purchase. Each terminal typically has an optical scanner which scans the items to be purchased for a machine readable bar code that identifies the item on its packaging. The operator is able to save time by scanning the items rather than having to manually key in price and product information. When an item is scanned, the optical scanner sends a signal corresponding to the product number of the item to the data processing component of the point-of-sale system, which then obtains from the database the price and the description of the scanned item.

More recently, self-serve checkout point-of-sales systems have been popularized. The self-serve checkout system enables shoppers to scan, bag and pay for their purchases with limited intervention from store personnel, typically for payment, product identification or problem resolution.

These systems typically have self-serve checkout stations that allow the customer to scan the bar codes that appear on the items to be purchased. The station may also provide other user-friendly mechanisms, such as a series of menu choices on a touch-screen monitor, and voice prompts to guide shoppers through the transaction process. It may also assist with entry of product code for items not possessing bar codes. The station may also have an icon on the touch screen which calls a supervisory employee to enter a product code for an uncoded item.

The customer then places the item in an identification area. Eventually the customer, or the system, moves the item to a bag packing or storage area. The self-serve checkout stations may have receipt printers, magnetic payment card readers and coupon acceptors to further reduce the time the supervisory employee must spend on each order. The stations typically are equipped to accept cash, coins, credit cards and debit cards.

Some self-serve checkout stations are described in U.S. Pat. Nos. 5,083,638, 5,115,888, 5,123,494, 5,125,465 and 5,168,961.

Self-serve checkout stations typically possess security features which deter customers from deliberately switching items. A cashier station manned by the supervisory employee typically is near several checkout stations. The proximity of the supervisory employee to the checkout stations has a natural tendency to discourage illicit activities at the checkout stations.

Another security feature includes comparing the weight changes on a packing scale at the identification area, which is adjacent to the scanner, with information retrieved from the computer database regarding the expected weight of the item. The packing area is also equipped with a weight scale, and the system keeps track of a running total weight as items are moved from the identification area to bags in the bagging area. A weighing platform comprising the identification area and bagging area typically accommodates no more than three bags of items at a time.

The self-serve checkout station may also be provided with a video camera unit which views the scales as the items are deposited. The video camera generates a signal received by a display in a supervisor station which allows a supervisory employee to approve non-bar coded items and to survey in general other items deposited on the scales. A plurality of self-serve checkout stations typically are selectively connected to a singular supervisor station by a switching unit, so that a single supervisory employee can monitor the activities at the plurality of checkout stations.

Automated self-serve checkout systems, such as the U-Scan Express® available from Optimal Robotics Corp., having video cameras and bagging platforms that recognize the weight of each scanned item have become popular amongst retailers throughout North America. The self-serve checkout systems have the potential to save supermarkets significant labor costs. In addition, shoppers find that self-service allows them to get in and out of retail stores more quickly.

The self-serve checkout systems known heretofore are designed as checkout systems for express lanes, i.e. 15 items or less. These self-serve checkout stations are not particularly suitable for large order purchases which require several bags to pack the items. The systems allow only a couple of bags at a particular checkout station to be weighed and monitored simultaneously.

SUMMARY OF THE INVENTION

The present invention overcomes these and other disadvantages of prior self-serve checkout systems and provides an apparatus for self-serve checkout of a large order purchase. The apparatus comprises a product code entry device that provides a product code signal corresponding to a product code of an item to be purchased, a rotating mechanism, a bag holding device that holds a plurality of bags open for packing a plurality of items, a scale underneath the rotating mechanism and the bag holding device, and a controller. The bag holding device is coupled with the rotating mechanism and rotates with the rotating mechanism to present a selected one of the plurality of open bags for packing the item to be purchased. The scale generates a weight signal representative of a weight of packed items in the plurality of bags held open by the bag holding device. The controller monitors the product code signal from the product code entry device and the weight signal from the scale to detect one or more abnormalities in the weight represented by the weight signal. The bag holding device may comprise a rack and a platter coupled to the rotating mechanism.

The product code entry device may be a scanner-scale that provides a second weight signal corresponding to a weight of a scanned item on the scanner-scale. The controller compares the weight of the scanned item to be purchased with a change in the weight represented by the weight signal from the scale.

The apparatus further may comprise a product lookup database. The controller retrieves a product entry, including a weight of the item to be purchased, from the product lookup database according to the product code signal corresponding to the item to be purchased, and compares the weight of the item to be purchased with a change in the weight represented by the weight signal from the scale.

The apparatus also may comprise a network interface coupled to the controller. The controller communicates through the network interface with a central point-of-sales database on an external network, and updates the product lookup database with product update information obtained from the centralpoint-of-sales database. The controller also may communicate through the network interface with a supervisor station on an external network.

The present invention also provides an apparatus for self-serve checkout of a large order purchase that comprises a product code entry device which provides a signal corresponding to a product code of an item to be purchased, a bag holding device that holds a plurality of bags open for packing a plurality of items, a first scale underneath the bag holding device which generates a first weight signal representative of a weight of packed items in the plurality of bags held open by the bag holding device, a large item holding assembly including a second scale generating a second weight signal representative of a weight of one or more oversized items on the large item holding assembly, and a controller receiving and monitoring the first weight signal from the first scale and the second weight signal from the second scale to detect one or more abnormalities in one or more of the weights represented by the first and second weight signals. The apparatus further may comprise a bill dispenser that dispenses up to three distinct denominations under a control of the controller.

BRIEF DESCRIPTION OF THE DRAWINGS

The above and numerous other objectives, features and advantages which may be achieved by the present invention can be more readily understood from the following detailed description by referring to the accompanying drawings wherein.

DETAILED DESCRIPTION OF THE INVENTION

In accordance with the present invention, an apparatus for self- serve checkout of large order purchases is provided. In one embodiment of the invention, a self-serve checkout station 1 with a carousel assembly 25 is provide. The carousel expands the capability of the self-serve checkout station beyond use in an express lane. Using the carousel-type self-serve checkout station, a shopper can scan and checkout a large number of, e.g., six, bags of groceries quickly, without waiting on a long, slow-moving line that is typical of a conventional large order lane at a retail store.

The station with the carousel is configured such that it is no more than a few inches greater in dimension than the express lane type self-serve checkout station. Therefore, a number of the carousel-type self-serve checkout stations can be placed at the front of, or elsewhere in, the retail store without additional allocation of space that may be needed for the shelving or display of merchandise.

Figure 1:
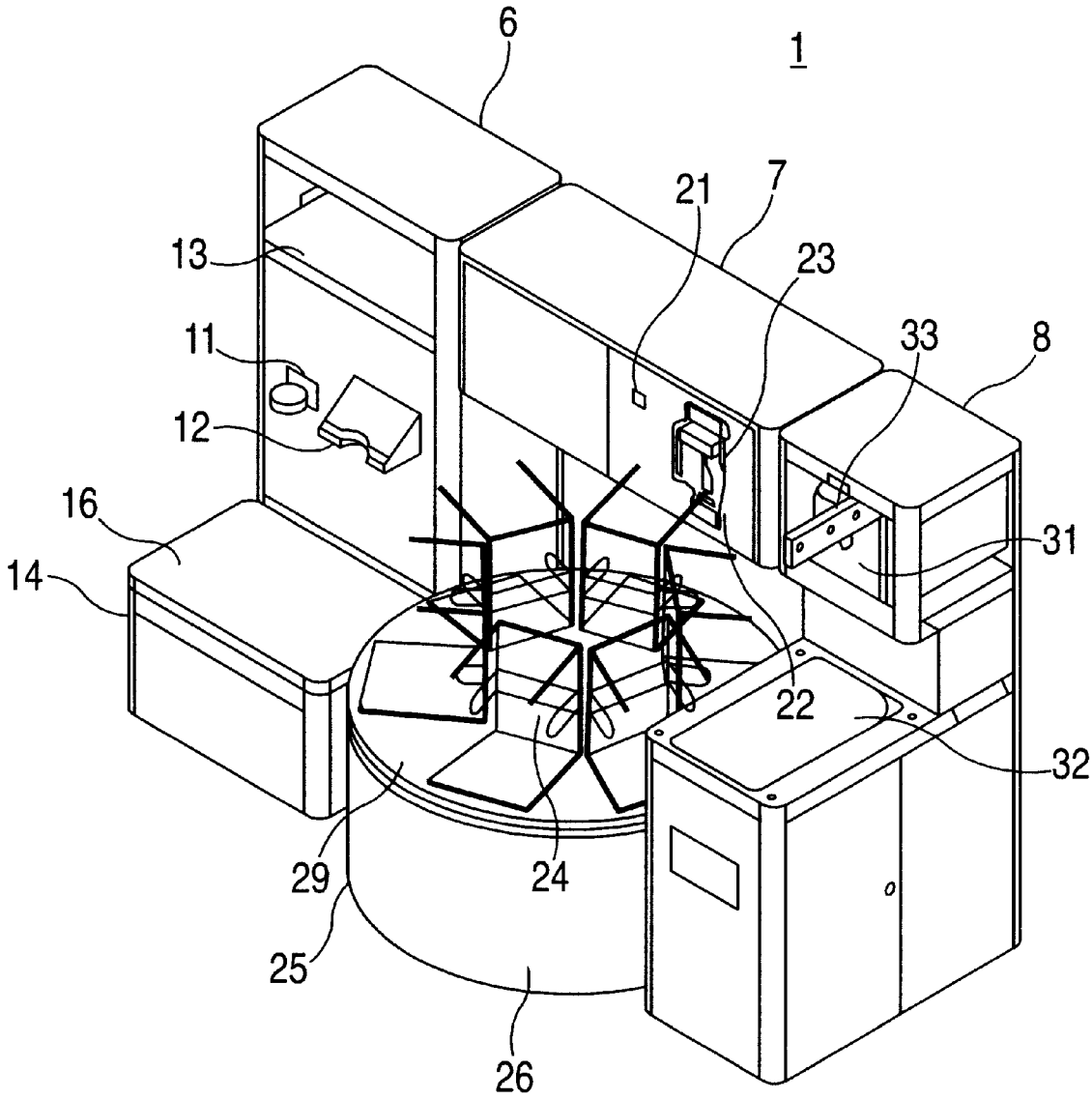
FIG. 1 shows a perspective view of a carousel-type self-serve checkout station, in accordance with a preferred embodiment of the present invention.
Figure 2A:
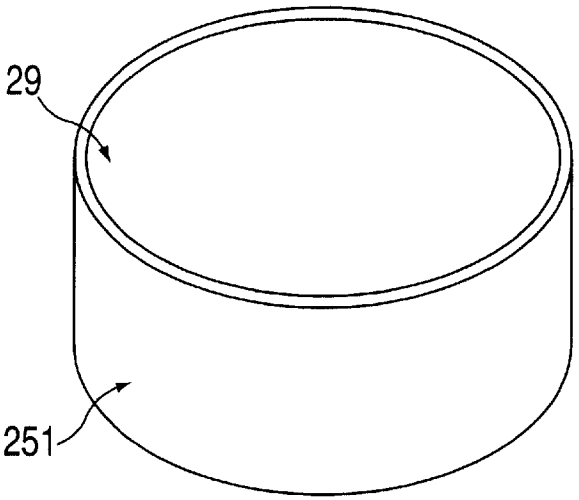
FIGS. 2A–2D show components of a bagging carousel assembly.
Figure 2D:
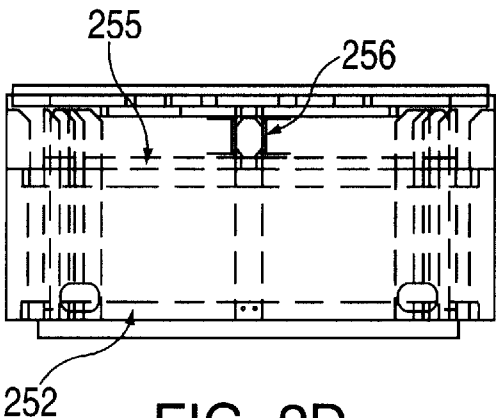
Figure 2B:
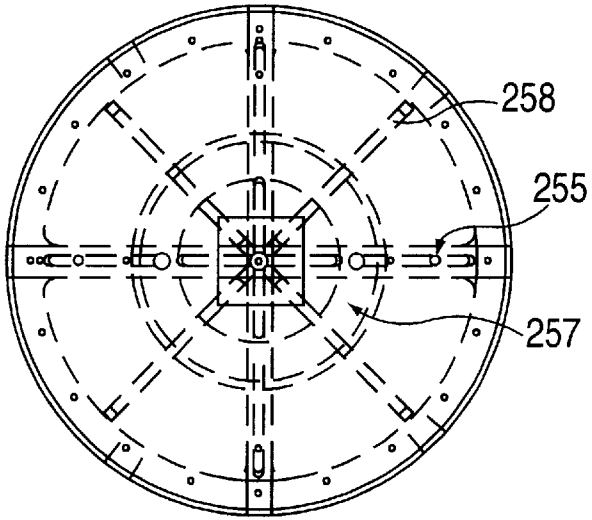
Figure 2C:
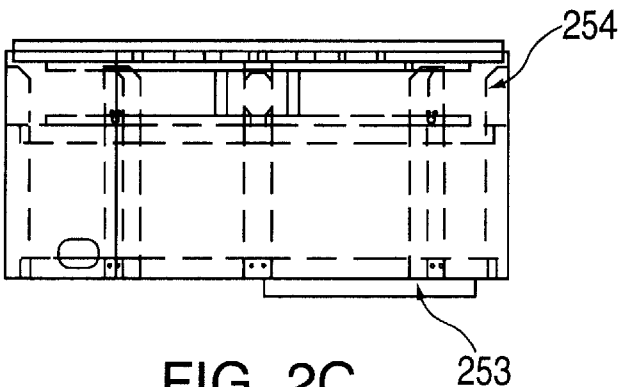
Figure 3A:
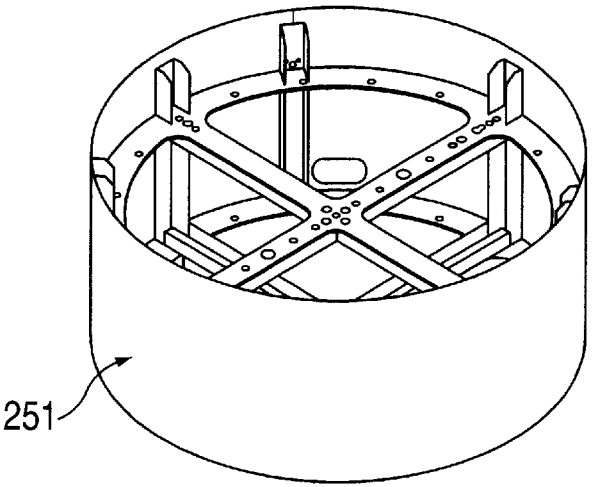
FIGS. 3A–3D show components of a bagging carousel assembly.
Figure 3D:
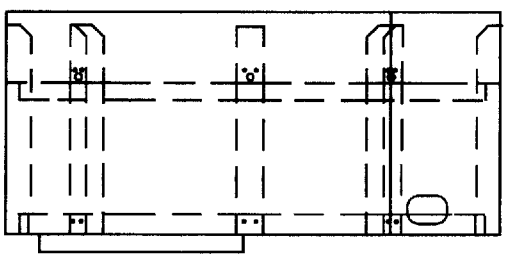
Figure 3B:
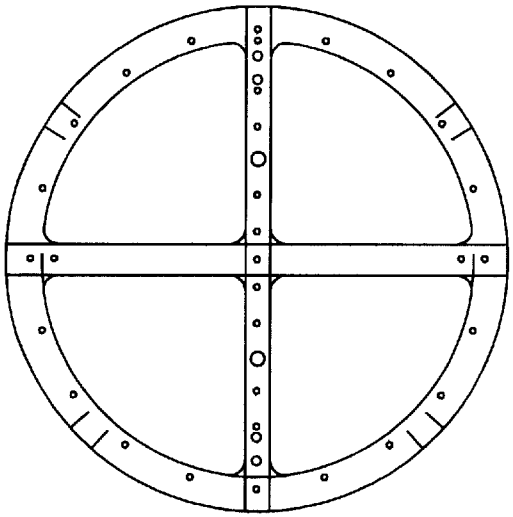
Figure 3C:
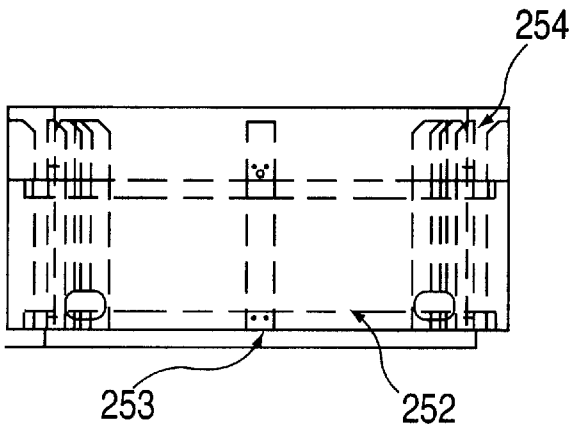
Figure 4A:
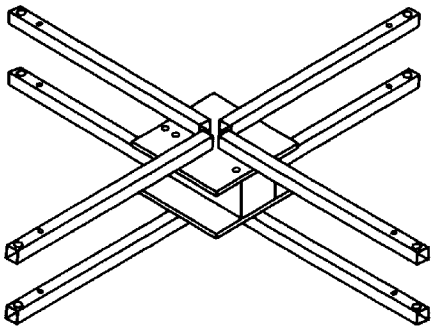
FIGS. 4A–4D show components of a bagging carousel assembly.
Figure 4D:
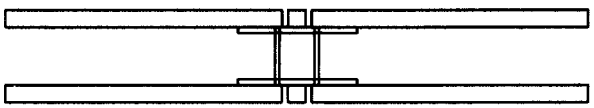
Figure 4B:
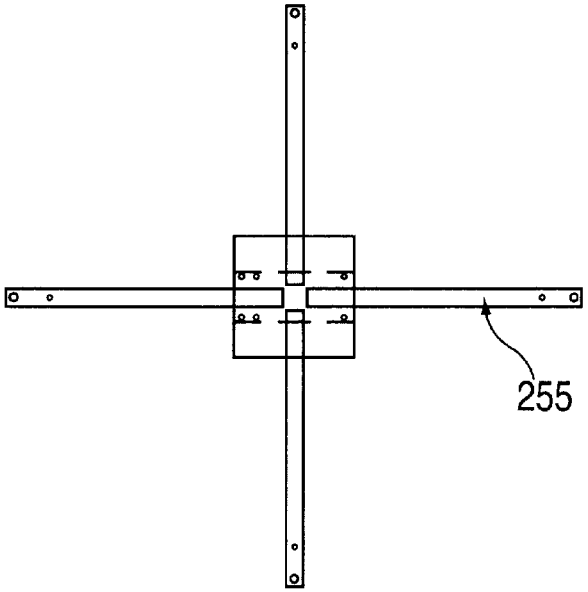
Figure 4C:
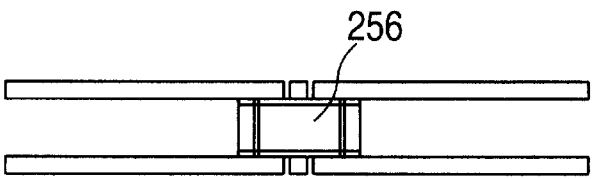
Figure 5A:
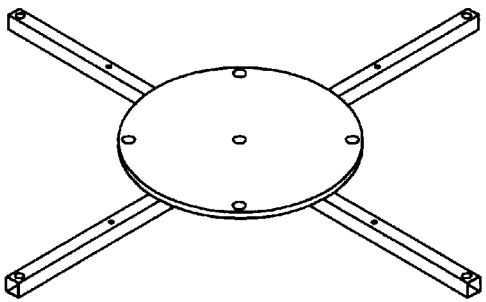
FIGS. 5A–5C show components of a bagging carousel assembly.
Figure 5D:
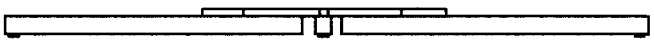
Figure 5B:
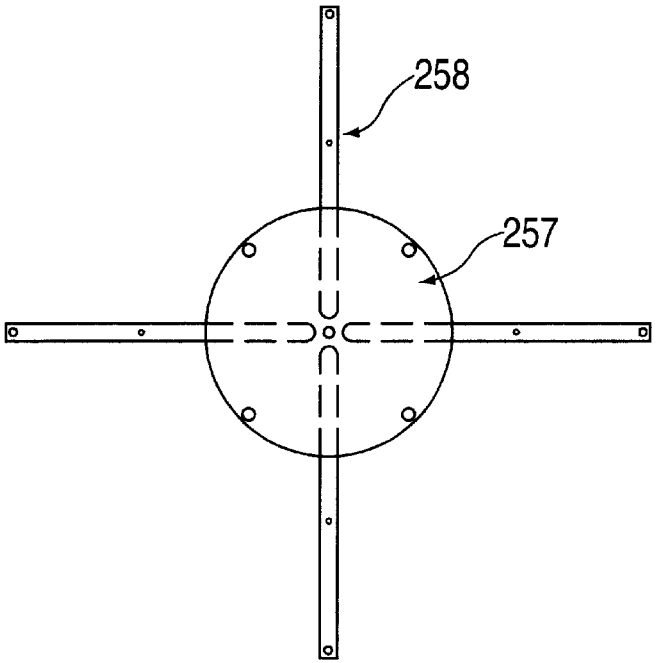
Figure 5C:
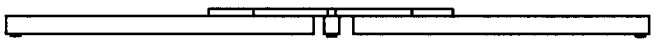
Figure 8:
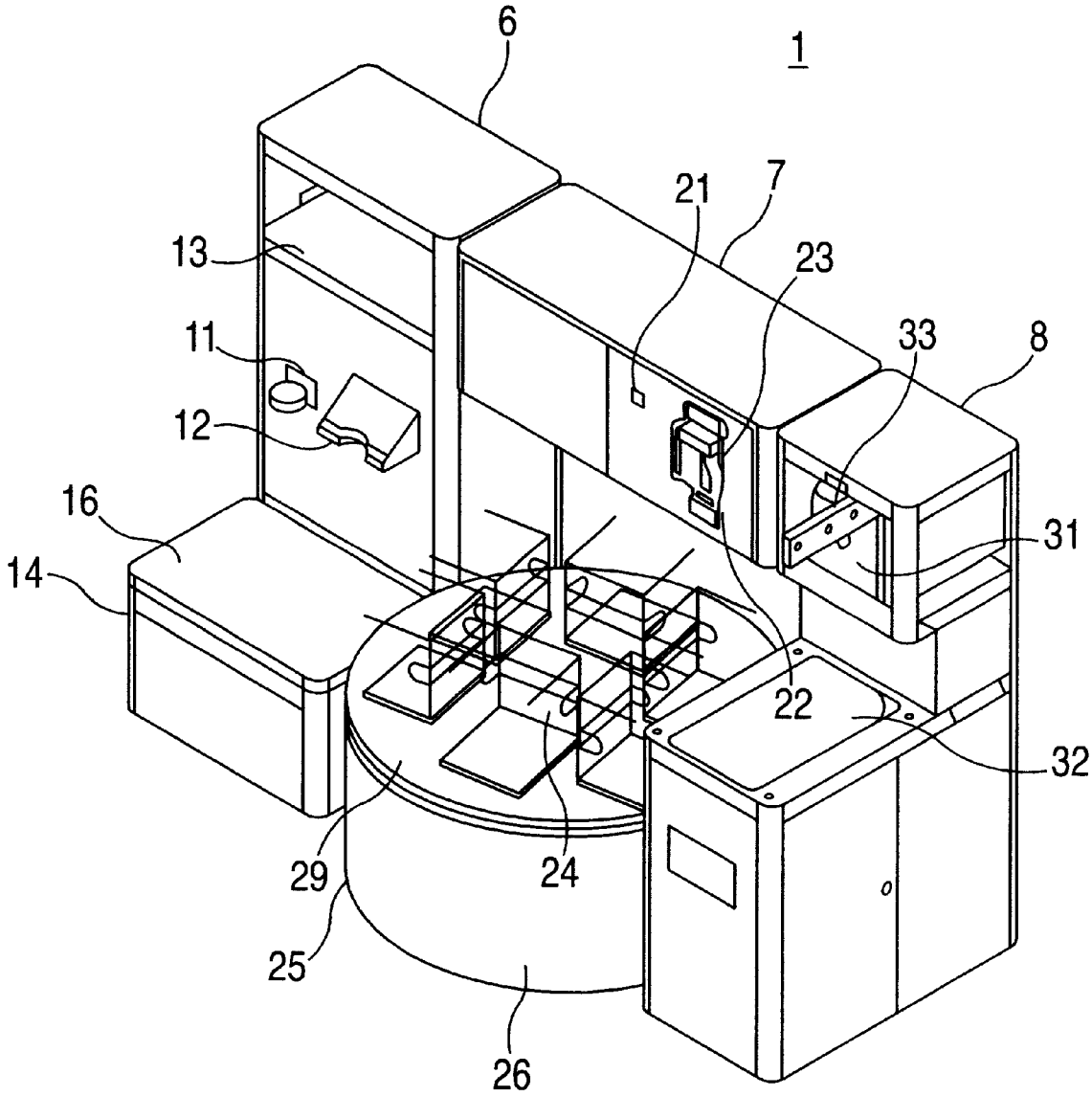
FIG. 8 shows a perspective view of a carousel-type self-serve checkout station, in accordance with an embodiment of the present invention.

FIGS. 1 and 8 show different implementations of a modular carousel-type self-server checkout station 1. Self-serve checkout station 1 includes modules 6, 7 and 8.

Module 8 includes touchscreen display 31, scanner-scale 32 and video camera 33. A microprocessor-based computer, which controls operations of the apparatus, is in a compartment of module 8 under the scanner-scale 32. A speaker and a microphone also may be provided. Scanner 32 may be supplemented, or perhaps replaced, by other devices 55, such as keypads, optical character scanners and/or voice input devices, for entering the product code of an item to be purchased.

Module 7 comprises coin acceptor 21, bill acceptor 22, reader 23 for credit cards, charge cards and/or store cards, bagging rack 24 and carousel assembly 25.

Rack 24 is configured for six bags. This configuration, however, is not a limitation of the present invention. A rack accommodating four, five, or more than six bags alternatively may be used. The capacity is only limited by the strength of the rack assembly and the size of the carousel.

Figure 6:
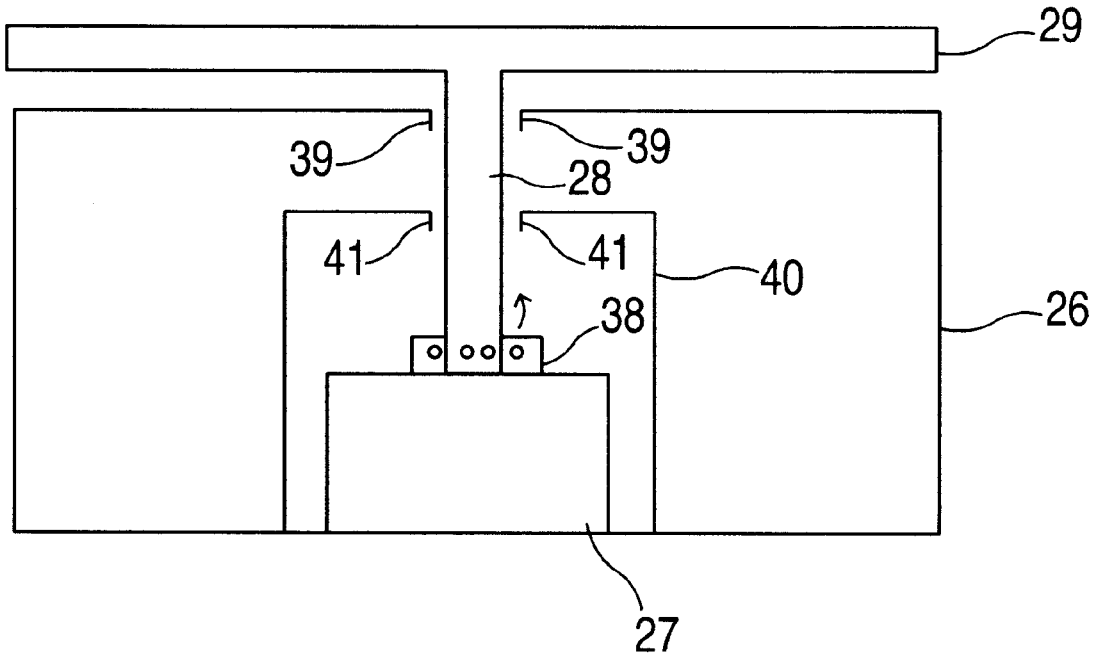
FIG. 6 is a cross-sectional view of a first embodiment of the carousel assembly for the checkout station of FIG. 1.

Referring to FIG. 6, one embodiment of the carousel assembly includes carousel housing 26, carousel scale 27, rotating mechanism 28 and carousel platter 29. The carousel platter 29 is supported by spindle 28 which rests on scale mechanism 27. The spindle is anchored to scale mechanism by ball bearing race 38, for example. The housing 26 has flange 39 to form a sleeve to hold the spindle 28 in place. Likewise, an inner housing 40 includes a pair of flanges 41 to provide further support to the spindle 28, and to cover and protect the ball bearing race 38. The spindle 28 contacts the scale 27 so that when items are added to the packing bags (not shown) on the rack 24, the scale registers the increase in weight and the system compares the expected weight (based upon the identification number of the item) with the weight of the item actually added to the scale.

Figure 7:
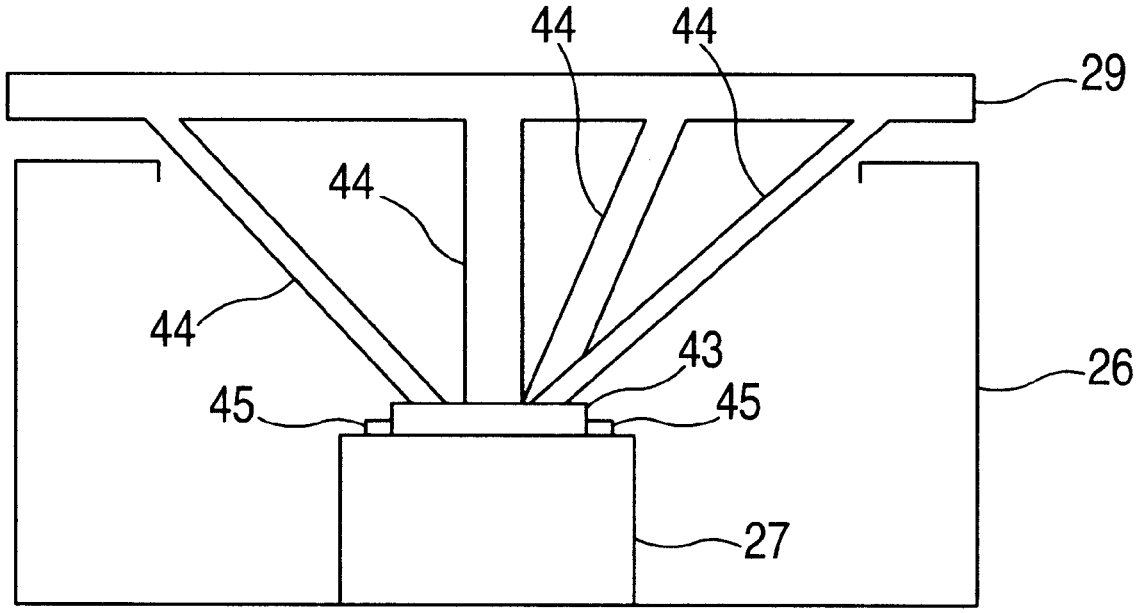
FIG. 7 is a cross-sectional view of a second embodiment of the carousel assembly for the checkout station of FIG. 1.

FIG. 7 illustrates an alternative carousel 25 embodiment for the check out stations of the present invention. The carousel includes a turntable 29 which is attached to a base 43 by a plurality of beams 44 which support the turntable 29 within the housing 26. The base 43 is journalled on the scale 27 by a ball bearing race 45 which holds the base 43 while permitting it to rotate. The race 45 may include detents (not shown) to stop the turntable 29 after it has rotated a predetermined amount (for example, a quarter turn for each of four bagging stations on the bagging rack 24)

The bagging rack 24 and carousel platter 29 are free to rotate so that the customer can select an appropriate bag into which a scanned item can be placed. The apparatus is able to maintain a stable weight and is unaffected by lateral movement and rotation.

Referring to FIGS. 2A–2D, 3A–3D, 4A–4D, and 5A–5D, an additional embodiment of the carousel assembly 25 is shown. The assembly 25 includes a carousel housing 251 under the rotating platter 29. A base 253 serves as an attachment point for mechanical fastening into the system 1. The housing 251 includes bottom and top cross bracing 252 as well as supporting ribs 254 to provide mechanical strength to the carousel assembly.

The carousel assembly includes a scale support assembly 400 (the assembly 400 is shown in perspective, top, side, and side views in FIGS. 4A–4D, respectively). The assembly 400 includes arms 255 extend from a central spindle. The arms provide for coupling of platter 29 to a scale load cell 256. The assembly 400 may be coupled to a rotating assembly 500 (FIGS. 5A–5D). The rotating assembly may include, for example, a lazy-Susan type of rotation device 257 coupled to support arms 258.

Module 6 includes coin dispenser 11, bill dispenser 12, receipt printer 13, and side assembly 14 for oversize or additional items. Bill dispenser 12 preferably is configured to dispense up to three distinct denominations. Conventional bill dispensers which dispense up to two distinct denominations alternatively may be used. Side assembly 14, which includes platter 16 and scale 17 (FIG. 9) under platter 16, is provided for additional bags or oversized items which cannot fit in a bag.

Operation of touchscreen display 31, scanner 32 and other product code entry devices, video camera 33, coin acceptor 21, bill acceptor 22, card reader 23, bagging rack 24, coin dispenser 11 and receipt printer 13 are conventional and known in the art, as described in, for example, U.S. Pat. Nos. 5,083,638, 5,115,888, 5,123,494, 5,125,465 and 5,168,961.

Side assembly scale 17 and carousel scale 27 in a preferred configuration are each able to verify the weight of items to within 2/100 of a pound, in accordance with an established weight database for monitoring security. Carousel scale 27 is rated up to 300 lbs. Side assembly scale 17 is rated up to 150 lbs. Carousel scale 27 and side assembly scale 17 work (a) separately to verify the weight of each item as it is placed on one of the platters and (b) in combination to verify the combined weight of the items purchased.

The modular configuration of station 1 permits modules 6 through 8 to be assembled from left to right or from right to left. Module 7 preferably is in the center to make packing more efficient. Alternatively, module 8 with scanner 32 may be in the center.

The modules are mounted on a single base with wheels (not shown) underneath the base. The unit may be easily wheeled into an appropriate place in the store. Levers (not shown) may be attached to the base. When the levers are lowered, the unit is lifted off the wheels.

Figure 9:
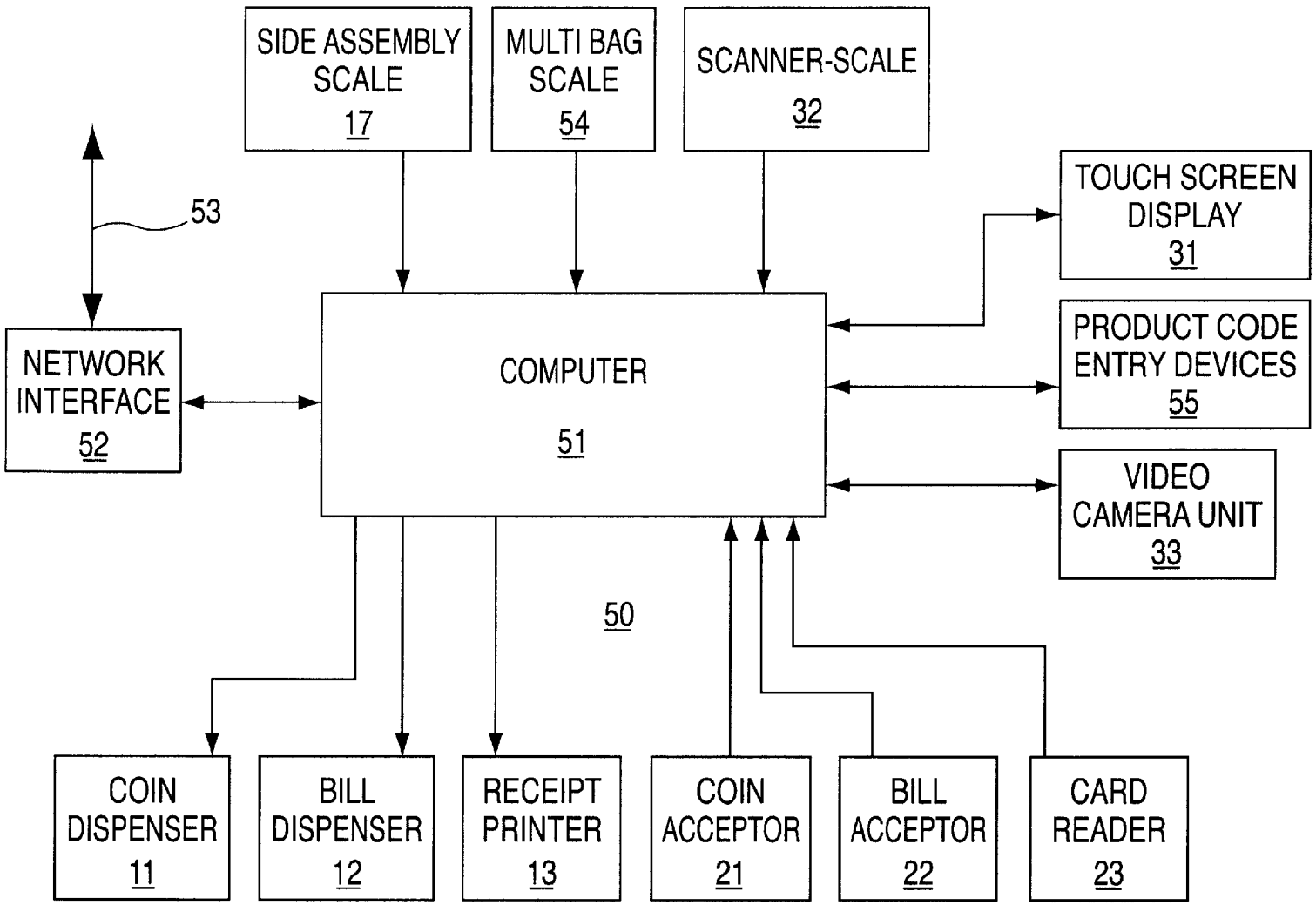
FIG. 9 shows a block diagram of a system for self-serve checkout of large order purchases in accordance with an embodiment of the present invention.

FIG. 9 shows a system for self-serve checkout of large order purchases, in accordance with an embodiment of the present invention. Self-serve checkout station includes a computer 51 which may be configured similar to known microprocessor-based computers and has a CPU, a plurality of storage devices and an I/O interface.

The storage devices may include program memory, RAM, non-volatile memory (such as ROM, EEPPROM, etc.), and any or a combination of the mass storage devices known conventionally in the art, such as floppy disk, optical disk, hard disk and/or tape cartridge drives, plus appropriate device drivers. A product lookup database may be stored in the storage devices.

The CPU communicates via the I/O interface with multi-bag scale 54, side assembly scale 17 and scanner-scale 32, as well as with touchscreen display 31, other product code entry devices 55, video camera 33, coin acceptor 21, bill acceptor 22, card reader 23, coin dispenser 11, bill dispenser 12 and receipt printer 13.

Computer 51 can communicate via network interface 52 with devices, such as a supervisor station, on network 53. Network 53 may be any one or a combination of LAN, WAN, wireless and other networks. Network interface 52 includes the appropriate units for interfacing with network 53, including, for example, Ethernet card, modem, RF transceiver, etc.

For example, when a shopper at the self-serve checkout station needs assistance with entry of a product code for an item, the shopper may request assistance using means, such as a button, provided via the user interface, e.g., on the touch screen display, for making the request. The request is processed by computer 51 and communicated along with information describing the subject item, e.g., textual or audio information from the shopper or video information from the camera unit, via network interface to a supervisor station on network 53. A response is communicated from the supervisor station on network 53 to computer 51 via network interface 52, and perhaps also conveyed to the shopper in an appropriate manner, e.g., on the video display or via a speaker.

As another example, computer 51 may download product and other information from a central point-of-sales database on network 53, on power-up as well as periodically during operation, via network interface 52. Thus, the product lookup database stored in the storage devices may be updated.

Computer 51 in a security capacity monitors the weights and weight changes on multi-bag scale 54, side assembly scale 17 and scanner-scale 32. Abnormal weights and weight changes are detected in a manner known in the art and, for example, described in U.S. Pat. Nos. 5,083,638, 5,115,888, 5,123,494 and 5,125,465.

The bagging rack is shown in FIG. 1 with one of many possible designs. The rack may take on any of the many designs known in the art that allow bags to remain in an open configuration so that items can be packed efficiently in the bags.

The carousel in the preferred embodiment shown in FIG. 1 is circular. The carousel, however, may be one of a number of other shapes, such as pentagonal, a hexagonal, octagonal, or the like. The main requirement is that the carousel assembly can accommodate multiple bags (three or more) in a large order purchase. It is also desirable that the carousel is rotatable such that the shopper can easily select an appropriate one of the multiple bags into which a scanned item can be placed.

While the computer in a preferred configuration described above is microprocessor-based, it may comprise an off-the-shelf personal or workstation-type computer appropriately programmed. Alternatively, the computer may be configured as a controller comprising a combination of discrete components, an ASIC (application specific integrated circuit) with program memory and RAM built-in, and/or a programmable logic array. Most importantly, the computer/controller should be programmable, in software, hardware or a combination of software and hardware, for monitoring the weights and weight changes on the scales in the system, and storing the weights of food and other items sold in a store.

Various changes and modifications of the described embodiments could be effected by one skilled in the art without departing from the spirit or scope of the invention recited in the appended claims. Improvements and modifications which become apparent to persons of ordinary skill in the art after reading this disclosure, the drawings and the appended claims are deemed within the spirit and scope of the present invention. It is therefore contemplated that the appended claims would cover any such modifications or improvements.

What is claimed is:

1. An apparatus for self-serve checkout comprising:

a product code entry device providing a product code signal corresponding to a product code of an item to be purchased;

a rotating bagging platform comprises a rack configured to receive a plurality of bags for packing, and said rotating bagging platform being configured to enable rotation of the plurality of bags by a self-checkout customer to present a selected one of the bags for packing by the self-checkout customer;

a scale coupled to the rotating bagging platform, the scale generating a weight signal representative of weight of the purchased items; and a controller configured to receive the product code signal from the product code entry device and the weight signal from the scale and further configured to detect a discrepancy in weight of the purchased items based on a comparison of weight information obtained upon input of the product code and weight of purchased items as represented by the weight signal.

2. The apparatus of claim 1 further comprising:

a large item holding assembly including a second scale generating a second weight signal representative of a weight of an oversized item on the large item holding assembly, wherein the controller monitors the second weight signal from the second scale to detect a discrepancy in weight of the oversized item based on a comparison of weight information obtained upon input of a product code corresponding to the oversized item to the weight represented by the second weight signal.

3. The apparatus of claim 1 wherein the product code entry device is a scanner-scale that provides a second weight signal corresponding to a weight of a scanned item on the scanner-scale, and, subsequent to removing said scanned item from the scanner-scale, the controller is configured to compare the weight of the scanned item to a change in the weight represented by the weight signal from the scale.

4. The apparatus of claim 1 further comprising:

a product lookup database comprising stored product weight data for a plurality of products; and wherein the controller is configured to obtain the weight information upon input of the product code by querying the product lookup database.

5. The apparatus of claim 4 further comprising:

a network interface coupled to the controller; and wherein the controller communicates through the network interface with a central point-of-sales database on an external network and updates the product lookup database with product update information obtained from the central point-of-sales database.

6. The apparatus of claim 1 further comprising:

a network interface coupled to the controller; and wherein the controller communicates through the network interface with a supervisor station on an external network.

7. An apparatus for self-serve checkout of a large order purchase, comprising:

a product code entry device providing a signal corresponding to a product code of an item to be purchased;

a bag holding device comprising a rack configured to hold a plurality of bags open for packing of a plurality of items by a self-checkout customer, said bag holding device being coupled to a rotatable platform to enable rotation of the plurality of bags by the self-checkout customer to thereby present a selected one of the bags for packing by the self-checkout customer;

a first scale underneath the bag holding device, the scale generating a first weight signal representative of a weight of packed items in the plurality of bags held open by the bag holding device;

a large item holding assembly including a second scale generating a second weight signal representative of a weight of one or more oversized items on the large item holding assembly; and a controller receiving and monitoring the first weight signal from the first scale and the second weight signal from the second scale to detect one or more abnormalities in one or more of the weights represented by the respective first and second weight signals.

8. The apparatus of claim 7 further comprising a bill dispenser dispensing up to three distinct denominations under a control of the controller.

9. A self-checkout apparatus comprising:

a product code entry device configured to receive product code data identifying purchased items;

a plurality of bagging platforms, each bagging platform comprising a scale generating a signal representing weight of ones of the purchased items placed upon said bagging platform and wherein the plurality of bagging platforms are rotatably coupled to a carousel assembly and configured to enable rotation of a plurality of bags to present customer-selected ones of the bags for packing by a self-checkout customer; and a controller coupled to each scale and configured to separately verify weight of each of said items as said items are placed on ones of the bagging platforms and to detect a combined weight of items placed on the plurality of bagging platforms.

10. The apparatus of claim 9 wherein the controller is configured to detect one or more a discrepancies in weight measured by said scales based on a comparison of weight information obtained upon input of a product code corresponding to a purchased item to weight detected by said scales.

11. The apparatus of claim 10 wherein the product code entry device is a scanner-scale that provides a weight signal corresponding to a weight of a scanned item on the scanner-scale and, subsequent to removing said scanned item from the scanner-scale, the controller is configured to compare the weight of said scanned item as measured by the scanner-scale with a change in the weight represented by weight signals from said bagging platform scales.

12. The apparatus of claim 11 further comprising:

a product lookup database comprising stored product weight data for a plurality of products, and wherein the controller is configured to obtain the weight information upon input of the product code by querying the product lookup database.

13. The apparatus of claim 12 further comprising:

a network interface coupled to the controller, wherein the controller communicates through the network interface with a central point-of-sales database on an external network, and updates the product lookup database with product update information obtained from the central point-of-sales database.

14. The apparatus of claim 12 wherein the controller communicates through the network interface with a supervisor station on an external network.

* * * * *